US009172170B2

(12) United States Patent
Dolinski et al.

(10) Patent No.: US 9,172,170 B2
(45) Date of Patent: Oct. 27, 2015

(54) BUS CONNECTOR WITH REDUCED INSERTION FORCE

(71) Applicant: ASCO Power Technologies, L.P., Florham Park, NJ (US)

(72) Inventors: Walter Dolinski, Sayreville, NJ (US); Michael Van Ness, Succasunna, NJ (US); John Bavoso, Hamilton Square, NJ (US); Josip Miskic, Clifton, NJ (US)

(73) Assignee: ASCO Power Technologies, L.P., Florham Park, NJ (US)

( * ) Notice: Subject to any disclaimer, the term of this patent is extended or adjusted under 35 U.S.C. 154(b) by 254 days.

(21) Appl. No.: 14/061,818

(22) Filed: Oct. 24, 2013

(65) Prior Publication Data

US 2015/0118878 A1 Apr. 30, 2015

(51) Int. Cl.

| | |
|---|---|
| ***H01R 25/16*** | (2006.01) |
| ***H01R 13/193*** | (2006.01) |
| *H01R 13/18* | (2006.01) |
| *H01R 13/53* | (2006.01) |

(52) U.S. Cl.

CPC ..... *H01R 13/193* (2013.01); *H01R 13/18* (2013.01); *H01R 13/53* (2013.01)

(58) Field of Classification Search

CPC ..... H01R 13/18; H01R 13/53; H01R 13/193
USPC ..... 439/212–213, 246, 79–81, 517, 851, 439/856–857, 861–863, 883, 947
See application file for complete search history.

(56) References Cited

U.S. PATENT DOCUMENTS

| | | | | |
|---|---|---|---|---|
| 4,684,191 | A * | 8/1987 | Feher | H01R 25/142 439/246 |
| 5,554,040 | A * | 9/1996 | Sugiura | H01R 25/14 439/212 |
| 5,618,187 | A * | 4/1997 | Goto | H01R 9/091 439/79 |
| 6,024,589 | A * | 2/2000 | Hahn, IV | H05K 1/148 174/71 B |
| 6,102,754 | A * | 8/2000 | Capper | H01R 13/113 439/517 |
| 6,398,580 | B2 * | 6/2002 | Lin | H01R 4/245 439/402 |
| 8,512,057 | B2 * | 8/2013 | Haar | H02G 3/0493 439/212 |
| 8,723,038 | B2 * | 5/2014 | Sakai | B60R 16/0238 174/68.2 |

* cited by examiner

*Primary Examiner* — Edwin A. Leon
(74) *Attorney, Agent, or Firm* — McDonnell Boehnen Hulbert & Berghoff LLP

(57) ABSTRACT

A bus connector configured for receiving a bus is provided. An example bus connector includes a plurality of contact fingers configured to engage with the bus. The plurality of contact fingers include a first set of contact fingers and a second set of contact fingers arranged substantially parallel to one another, and the first set and second set clamp the bus when the bus is inserted between the first set and the second set. The bus connector further includes a connector frame, wherein the connector frame is configured to hold the plurality of contact fingers. The plurality of contact fingers includes contact fingers of a first length and contact fingers of a second length, wherein the second length is different than the first length.

20 Claims, 10 Drawing Sheets

BUS CONNECTOR WITH REDUCED INSERTION FORCE

BACKGROUND

Unless otherwise indicated herein, the materials described in this section are not prior art to the claims in this application and are not admitted to be prior art by inclusion in this section.

The present disclosure is generally directed to bus connector assemblies for use with an electric power switching apparatus. More specifically, the present disclosure is generally directed to a bus connector for use with an electric power switching apparatus with isolation means such as a transfer switch or a circuit breaker. Such connector assemblies allow the switching apparatus to achieve a very high withstand current ratings. For example, the high withstand current rating may be 100,000 amperes or above. In one arrangement, the present disclosure relates generally to a connector assembly arrangement that may be used for interconnection between a device and a bus structure. More particularly, the connector assembly arrangement may be used in an isolation-bypass automatic transfer switch. However, aspects of the present disclosure may be equally applicable in other scenarios as well.

An automatic transfer switch is designed to provide a continuous source of power for critical loads by automatically transferring from a normal power source to an emergency power source when the normal power source falls below a preset limit. Automatic transfer switches are in widespread use in, e.g., airports, subways, schools, hospitals, military installations, industrial sites, and commercial buildings equipped with secondary power sources and where even brief power interruptions can be costly or perhaps even life threatening. Transfer switches operate, for example, to transfer a power consuming load from a circuit with a normal power supply to a circuit with an auxiliary power supply. A transfer switch can control electrical connection of utility power lines and the diesel generator to facility load buses. In certain installations, the transfer switch automatically starts a standby generator and connects the standby generator to the load bus upon loss of utility power. In addition, the transfer switch can automatically reconnect the utility power to the load bus if utility power is reestablished.

Automatic transfer switches are typically of two types: (i) an automatic transfer switch comprised of a single switching apparatus mounted in an enclosure; and (ii) an automatic transfer switch interconnected with a redundant switch (e.g., manual or automatic switch) mounted in a single enclosure or in multiple adjacent enclosures. This second configuration is typically referred to as a bypass-isolation transfer switch. Typically, one or both switches are provided with isolation means allowing disconnecting the switch from a bus structure and removal out of the enclosure.

SUMMARY

A bus connector configured for receiving a bus is provided. In an example embodiment, the bus connector includes (i) a plurality of contact fingers configured to engage with the bus and (ii) a connector frame, wherein the connector frame is configured to hold the plurality of contact fingers. The plurality of contact fingers comprise a first set of contact fingers and a second set of contact fingers arranged at least substantially parallel to one another, wherein the first set and second set clamp the bus when the bus is inserted between the first set and the second set. The plurality of contact fingers includes contact fingers of a first length and contact fingers of a second length, wherein the second length is different than the first length.

In another example embodiment, the bus connector includes (i) a plurality of contact fingers configured to engage with the bus and (ii) a connector frame, wherein the connector frame is configured to hold the plurality of contact fingers. The plurality of contact fingers comprise a first set of contact fingers and a second set of contact fingers arranged at least substantially parallel to one another, wherein the first set and second set clamp the bus when the bus is inserted between the first set and the second set. Further, each set of contact fingers comprises (i) a plurality of contact fingers that create a first contact point at a first distance from the connector frame and (ii) a plurality of contact fingers that create a second contact point at a second distance from the connector frame different than the first distance.

In yet another example embodiment, the bus connector includes (i) a plurality of contact fingers configured to engage with the bus and (ii) a connector frame, wherein the connector frame is configured to hold the plurality of contact fingers. The plurality of contact fingers comprise a first set of contact fingers and a second set of contact fingers arranged at least substantially parallel to one another, wherein the first set and second set clamp the bus when the bus is inserted between the first set and the second set. Further, the plurality of contact fingers creates at least two different points of contact between the contact fingers and the bus when the bus is inserted into the bus connector.

The foregoing summary is illustrative only and is not intended to be in any way limiting. In addition to the illustrative aspects, embodiments, and features described above, further aspects, embodiments, and features will become apparent by reference to the figures and the following detailed description.

DETAILED DESCRIPTION

Figure 1:
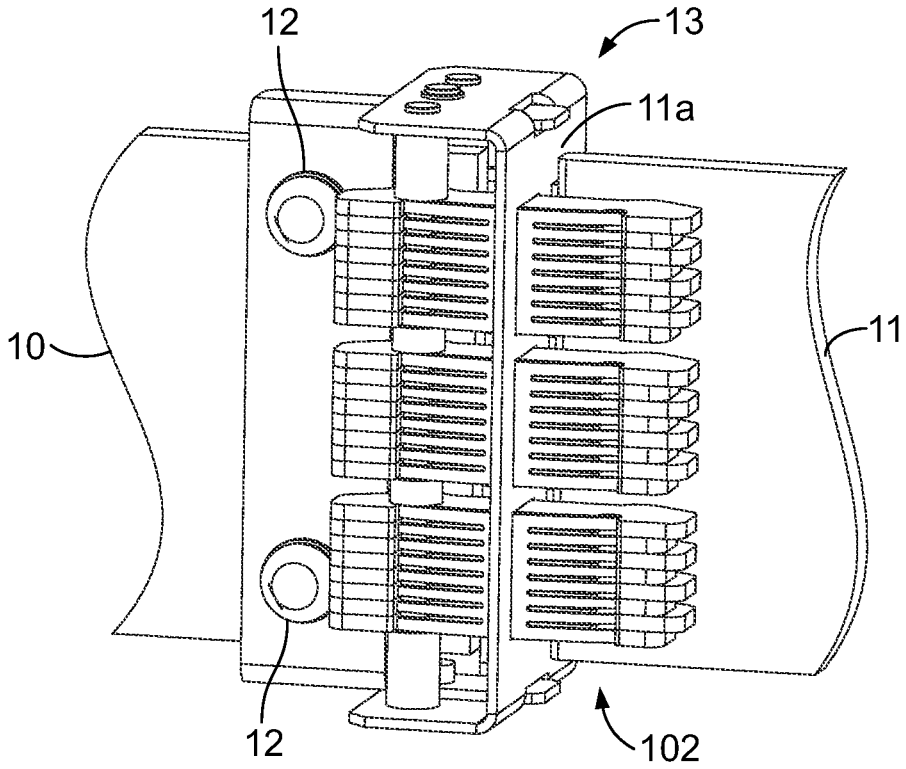
FIG. 1 is a perspective view of an example bus connector connected to an example bus, according to an example embodiment of the present disclosure.

In the following detailed description, reference is made to the accompanying drawings, which form a part hereof. In the drawings, similar symbols typically identify similar components, unless context dictates otherwise. The illustrative embodiments described in the detailed description, drawings, and claims are not meant to be limiting. Other embodiments may be utilized, and other changes may be made, without departing from the spirit or scope of the subject matter presented herein. It will be readily understood that the aspects of the present disclosure, as generally described herein, and illustrated in the figures, can be arranged, substituted, combined, separated, and designed in a wide variety of different configurations, all of which are explicitly contemplated herein.

1. Overview

As mentioned above, automatic transfer switches are typically of two types: (i) an automatic transfer switch comprised of a single switching apparatus mounted in an enclosure; and (ii) an automatic transfer switch interconnected with a redundant manual, or automatic, switch mounted in a single enclosure, or in multiple adjacent enclosures. The second configuration is typically referred to as bypass-isolation transfer switch. Typically, one or both switches are provided with isolation means allowing disconnecting the switch from a bus structure and removal out of the enclosure. The removable switch is typically provided with connectors that connect or disconnect a switch from the fixed bus structure within the enclosure. Although certain transfer switches or circuit breakers may utilize connectors of various designs, a connector designed to withstand very high short circuit forces can employ the electromagnetic forces to keep connector contacts closed by clamping onto the bus.

It would be desirable to provide a cost-effective connector design that is easy to assemble and install, scalable to different bus sizes, and configurable for different short circuit current levels. Further, there is also a general need for a connector with a low insertion force to reduce stress exerted onto the connector parts and to reduce the overall size and weight of isolation mechanism components.

An example bus connector in accordance with the present disclosure may include a plurality of contact fingers configured to engage with a bus. The plurality of contact fingers may include a first set of contact fingers and a second set of contact fingers arranged substantially parallel to one another, wherein the first set and second set clamp the bus when the bus is inserted between the first set and the second set. The bus connector may further include a connector frame, wherein the connector frame is configured to hold the plurality of contact fingers. Further, the plurality of contact fingers comprise contact fingers of a first length and contact fingers of a second length, wherein the second length is different than the first length. The bus may encounter a frictional force between the bus and the contact fingers as the bus is being inserted between the first set and the second set. The plurality of contact fingers may be arranged such that a total frictional force is distributed between (i) a first point of contact formed by the contact fingers of the first length and (ii) a second point of contact formed by the contact fingers of the second length.

Beneficially, the disclosed bus connector reduces the insertion force required to insert a moving bus into the bus connector. Further, the disclosed bus connector beneficially is easy to assemble and install, scalable to different bus sizes, and configurable for different short circuit current levels.

The disclosed bus connector may be used with an electric power switching apparatus. For example, the disclosed bus connector may be used with an electric power switching apparatus with isolation means such as a transfer switch, or a circuit breaker. In one arrangement, the present disclosure relates generally to a connector assembly arrangement that may be used for interconnection between a device and a bus structure (e.g., in an isolation-bypass automatic transfer switch). However, aspects of the present disclosure may be equally applicable in other scenarios as well.

2. Example Bus Connector

FIGS. 1-17 illustrate example bus connectors and bus-connector components, in accordance with example embodiments of the present disclosure. It should be understood, however, that numerous variations from the arrangement and functions shown are possible while remaining within the scope and spirit of the claims. For instance, elements may be added, removed, combined, distributed, substituted, re-positioned, re-ordered, or otherwise changed. Still further, it should be understood that all of the discussion above is considered part of this detailed disclosure.

Figure 2:
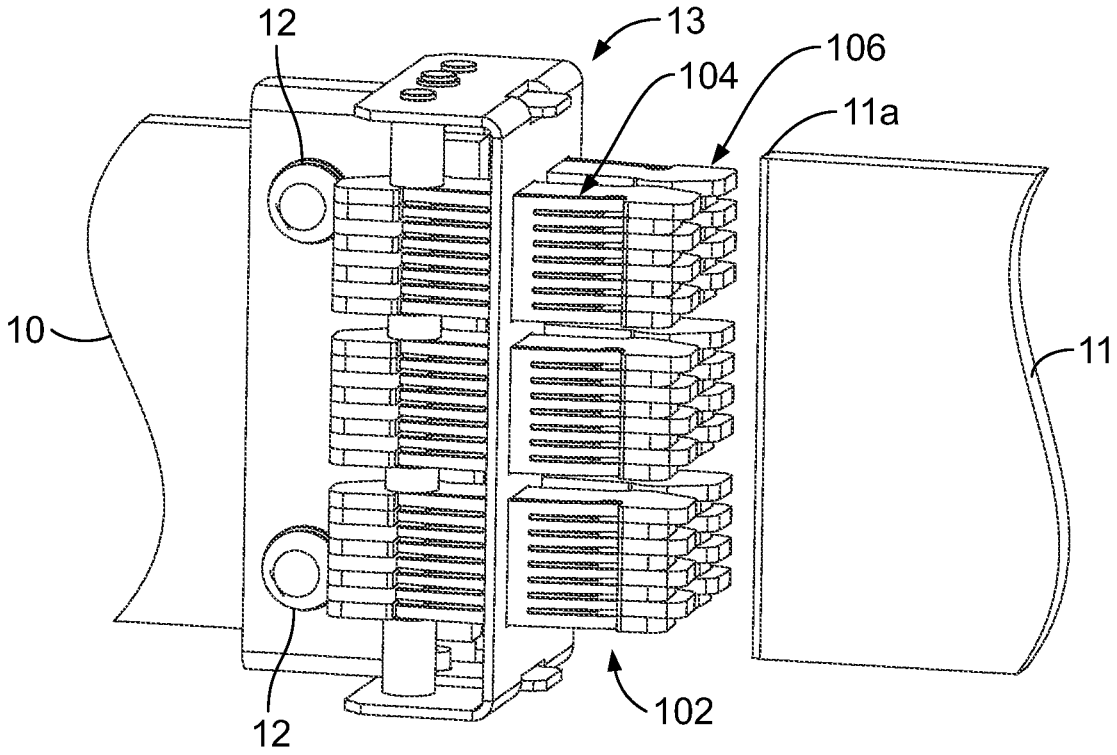
FIG. 2 is a perspective view of the example bus connector of FIG. 1 prior to being connected to the example bus of FIG. 1.

FIGS. 1 and 2 illustrate an example bus connector 13 attached to a fixed copper bus 10 with connector mounting hardware 12. The fixed bus 10 may, for example, be attached to a switch. Further, a switch may be connected to a larger bus system (e.g., with the described bus connectors). The disclosed system beneficially provides means of moving the switch and connecting or isolating it from the bus system. It should be understood that the depicted copper bus and fixed bus arrangement is intended as an example only, and that other suitable copper bus 10 and bus 11 arrangements may be used. As just one example, copper bus 10 may comprise a movable copper bus and the moving bus 11 may comprise a fixed bus 11. Indeed, the moving bus may comprise any type of bus that moves relative to the plurality of contact fingers.

With reference to FIG. 1, a moving bus such as moving bus 11 may be inserted into the bus connector 13. The bus connector 13 may include a plurality of contact fingers configured to engage with the bus. For instance, bus connector 13 may include a plurality of contact fingers 102. The plurality of contact fingers may include a first set of contact fingers and a second set of contact fingers arranged substantially parallel to one another, such as first set 104 and second set 106. The first set 104 and the second set 106 clamp the bus 11 when the bus is inserted between the first set and the second set. The bus connector 13 may also include a connector frame 1 configured to hold the plurality of contact fingers 102. Further, the connector frame 1 may also be configured to attach to fixed copper bus 10 with connector mounting hardware 12.

Figure 3:
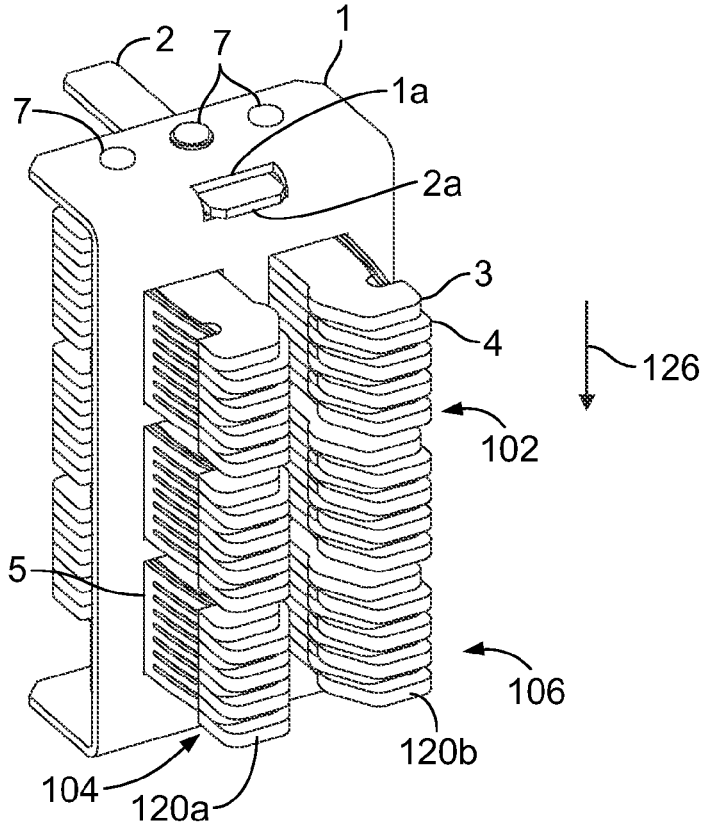
FIG. 3 is a perspective view taken from a top, front, left side of the example bus connector of FIG. 1.

In accordance with an example embodiment, the plurality of contact fingers 102 may include contact fingers of a first length and contact fingers of a second length different than the first length. For instance, as shown in FIG. 3, contact finger 4 is a first length, while contact finger 3 is a second length. In this depicted example, contact finger 4 is longer than contact finger 3. Each contact finger in the first set 104 corresponds to a contact finger in the second set 106. These corresponding contact fingers exert opposing forces on the bus so as to clamp the bus when the bus is inserted. Preferably, these corresponding contact fingers may be the same length. For instance, with reference to FIG. 3, contact finger 120*a* in the first set 104 corresponds to contact finger 120*b* in the second set 106. These corresponding contact fingers 120*a* and 120*b* are the same length, and together these contact fingers operate to clamp the bus 11.

Figure 8A:
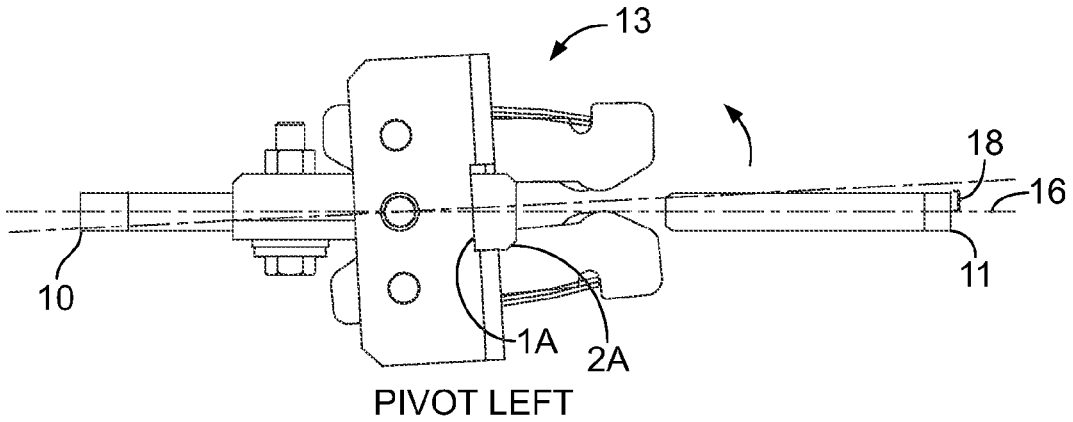
FIGS. 8*a-c* are top plan views of the bus connector of FIG. 1 prior to being connected to the example bus of FIG. 1, according to an example embodiment of the present disclosure.
Figure 8B:
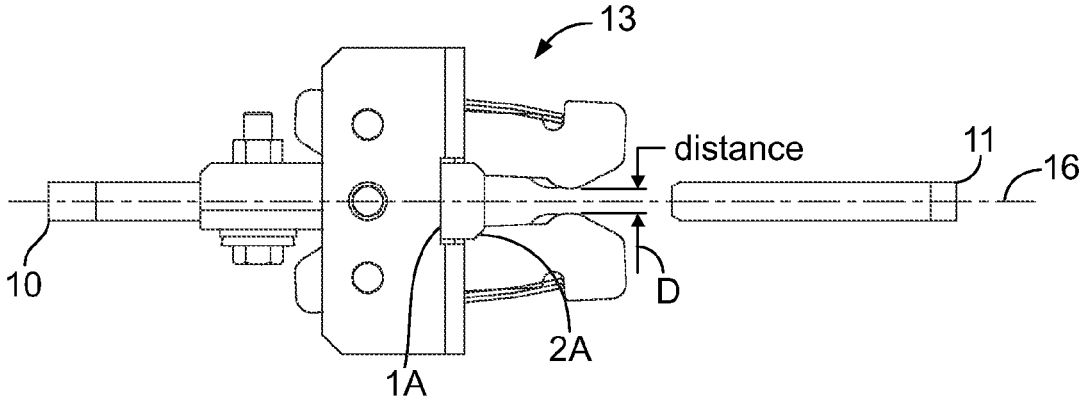

The first set 104 and the second set 106 are capable of outward deflection when the bus 11 is pushed inwardly with respect to the contact fingers. When the initial friction between the contact fingers 102 and the leading edge 11*a* of the moving bus 11 is overcome by an insertion force, the moving bus 11 slides in until fully engaged as shown in FIG. 1. With reference to FIGS. 1, 8*a-c*, and 9*a*, when moving bus 11 is inserted into the bus connector 13, the first set 104 and the second set 106 of contact fingers are spread out by the leading edge 11*a* of the moving bus 11. As seen in FIG. 8*b*, prior to insertion a distance D between the first set 104 and the second set 106 is less than the distance between the sets 104, 106 after the bus 11 is inserted between them. When the contact fingers are spread out, the contact fingers provide a clamping force that clamps the moving bus 11.

As mentioned above, the first set 104 and second set 106 of contact fingers are at least substantially parallel to one another. In an example embodiment, the first set 104 and second set 106 of contact fingers arranged in parallel to each other with the mowing bus in between the contact fingers when fully engaged. This configuration is optimal for magnetic clamp-on force. Beneficially, by being at least substantially parallel, the contact fingers can clamp onto a generally flat moving bus. However, in general, the contact fingers may be arranged in any suitable formation to clamp a given bus.

Figure 5:
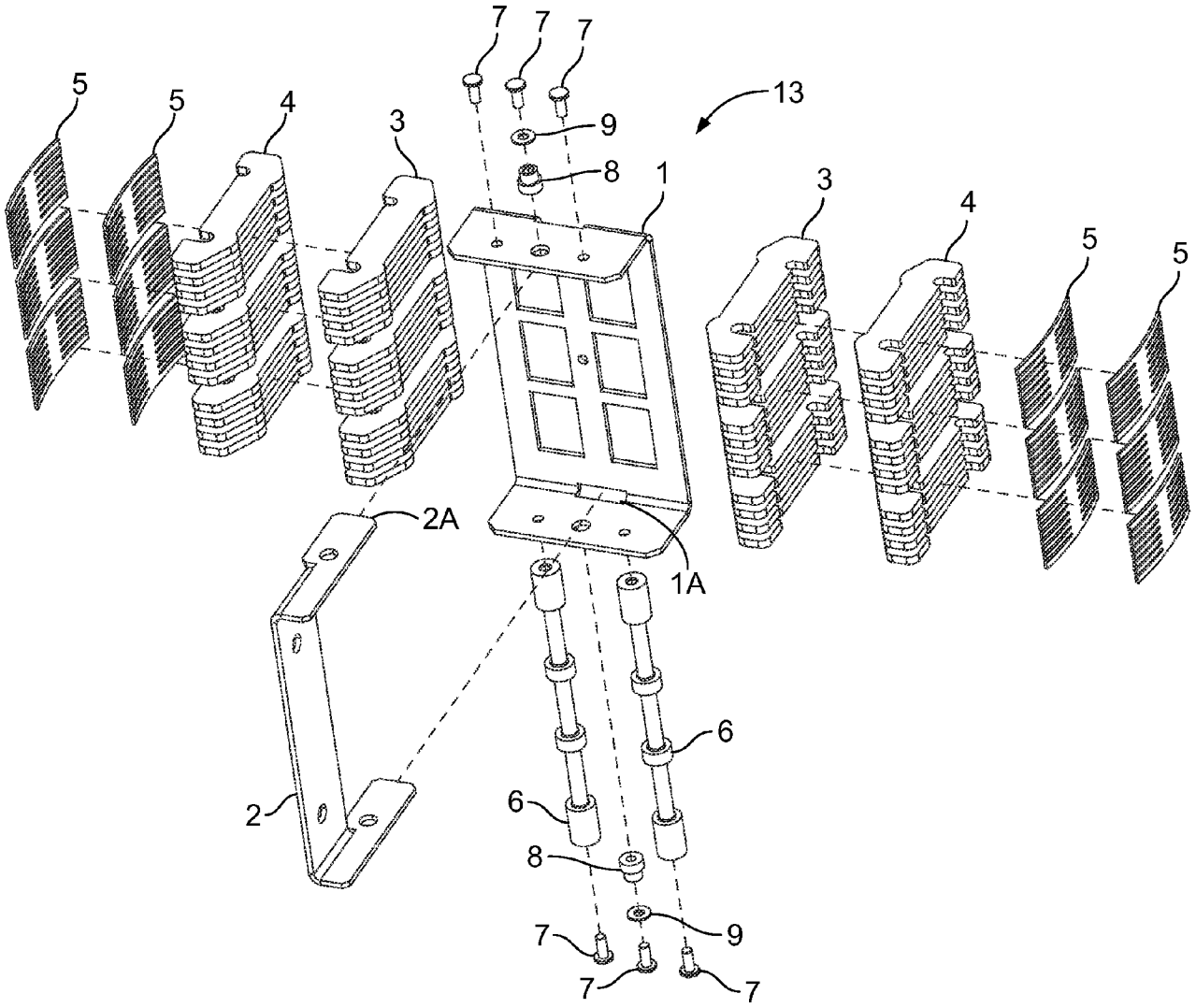
FIG. 5 is an exploded perspective view of the example bus connector of FIG. 1 taken from a top, back, right side.

FIG. 5 is an exploded perspective view of bus connector 13, and this figure depicts example components that bus connector 13 may include. In particular, bus connector 13 may include connector frame 1 attached to mounting bracket 2 with pivot bushings 8, washers 9, and pins 7. Contact fingers 4 of a first length (e.g., the longer contact fingers) and contact fingers 3 of the second length (e.g., the shorter contact fingers) are held together by finger rods 6 pinned to the contact frame 1 with pins 7. Further, springs 5 are inserted between connector frame 1 and the contact fingers 3, 4. In this position, springs 5 exert pressure on contact fingers 3, 4, and this pressure may provide the clamping force to hold bus 11 in place.

Typically, higher currents require more contact fingers to withstand current without overheating. The basic configuration of the disclosed bus connector is beneficially scalable as needed for specific application requirements. For instance, the contact fingers and springs can be used in various multiples depending on how much current is passing through the connectors. Further, the contact springs can be used in parallel to multiply effective spring force exerted onto the contact fingers. Generally, higher finger forces allow for better electrical connections and higher currents without overheating components. Therefore, it is possible to lower the overall cost of a switch device by using fewer number and smaller sizes of connector components.

Figure 6:
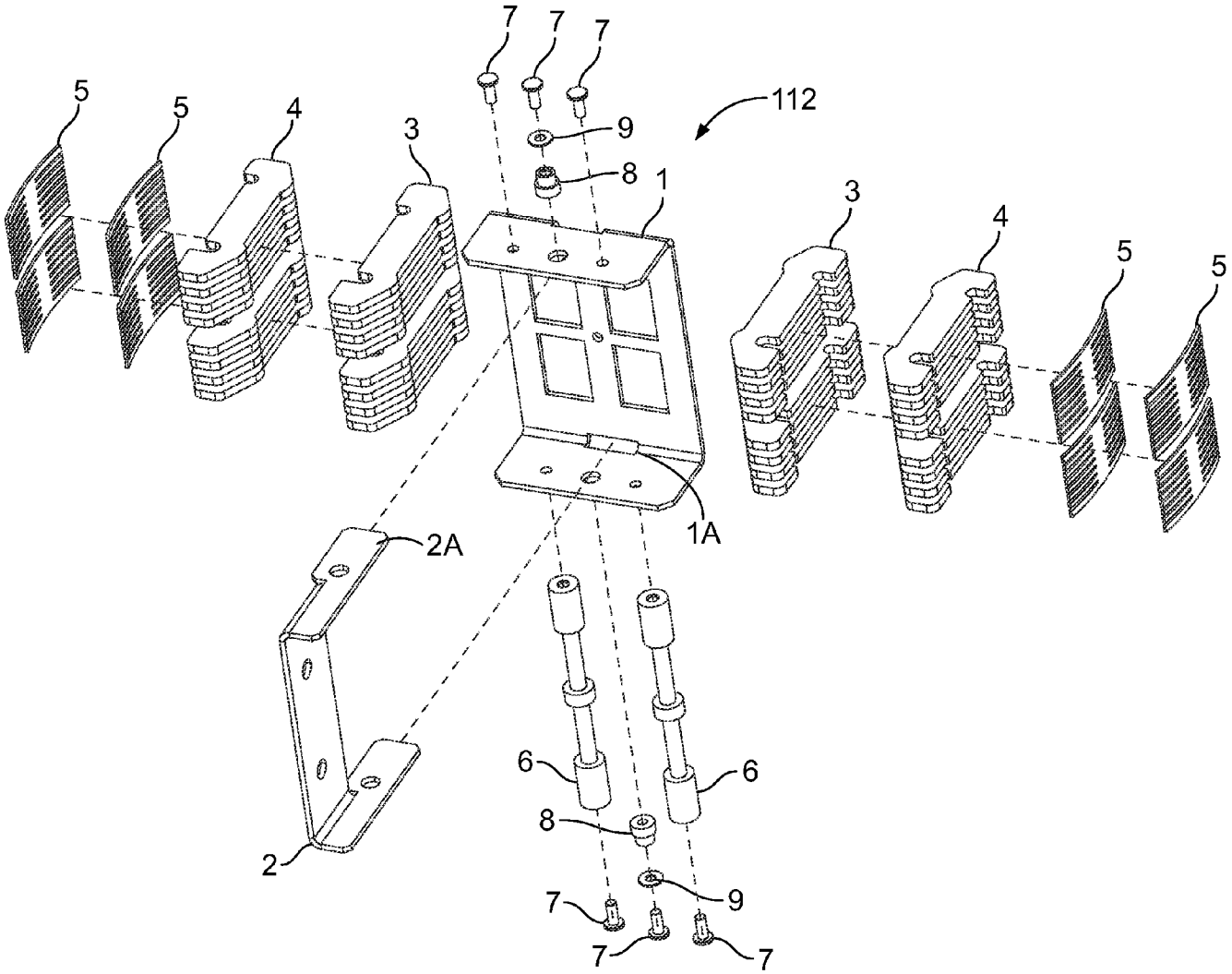
FIG. 6 is an exploded perspective view of another example bus connector taken from a top, back, right side, according to an example embodiment of the present disclosure.
Figure 7:
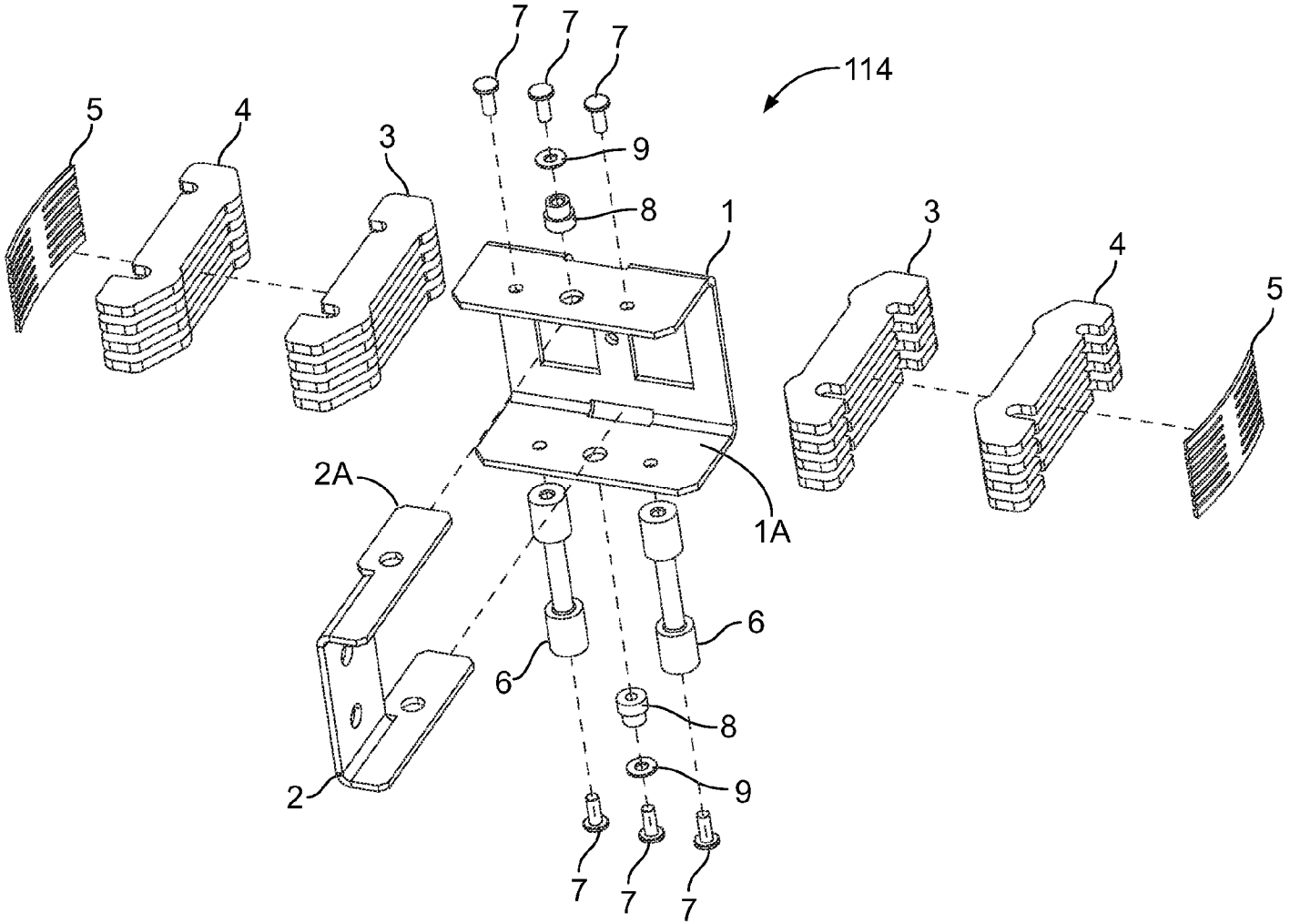
FIG. 7 is an exploded perspective view of yet another example bus connector taken from a top, back, right side, according to an example embodiment of the present disclosure.

Returning to the figures, FIGS. 5, 6, and 7 each show different embodiments of the bus connector that can be used for different application requirements. In particular, the connector frame 1, mounting bracket 2, and rods 6 are specifically shown in different sizes to accommodate different number of contact fingers 3, 4 and finger springs 5. FIG. 5 depicts the bus connector 13, FIG. 6 depicts a bus connector 112 that has fewer contact fingers, and FIG. 7 depicts a bus connector 114 that has even fewer contact fingers. These different connector configurations may beneficially match specific application requirements. For example, FIG. 5 shows a typical configuration required to withstand high short-circuit magnetic forces due to current of magnitude of 100,000 A. On the other hand, FIG. 7 shows a typical configuration that may be applicable for current of magnitude of 50,000 A. It should be understood that these are merely three example configurations, and other configurations may be used for different magnitudes of current.

Figure 8C:
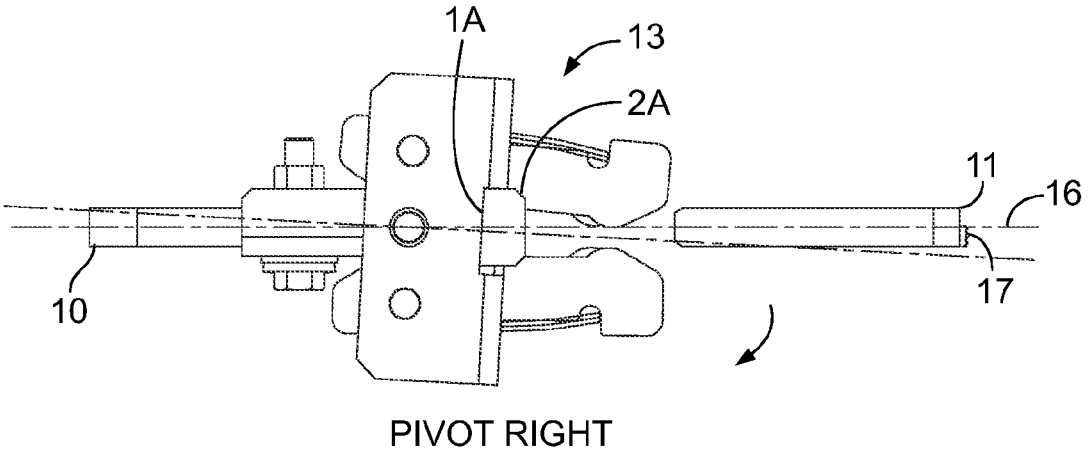

In an example embodiment, the bus connector 13 may be pivoted to move about an axis, so as to allow the bus connector to pivot and align with moving bus 11. For example, as shown in FIGS. 8*a-c*, the connector frame 1 may be configured to allow the contact fingers to move about a central axis 16. Connector frame 1 may include pivot window 1A and connector mounting bracket 2 may include pivot tab 2A. In conjunction with one another, pivot window 1A and pivot tab 2A allow the bus connector 13 to pivot and align itself to moving bus 11. The pivot tab 2A and pivot window 1A interact with one another to control the maximum angle that the bus connector 13 can pivot. In particular, pivot window 1A will limit the right pivot angle 17 and the left pivot angle 18, as shown in FIGS. 8*a* and 8*c* respectively.

When the moving bus is inserted into the bus connector, an insertion force is applied to the bus. In order to initially overcome the frictional force between the contact fingers and the moving bus, the insertion force should be greater than the frictional force. As mentioned above, the plurality of contact fingers may include contact fingers of a first length and contact fingers of a second length different than the first length. By using contact fingers of different lengths, the initial insertion force required to insert a moving bus into a bus connector may be reduced. By having contact fingers of different lengths, this frictional force beneficially may be spread out or distributed among two (or perhaps more) contact points. As such, the initial insertion force required to initially overcome the frictional force between the contact fingers and the bus is reduced.

Figure 9A:
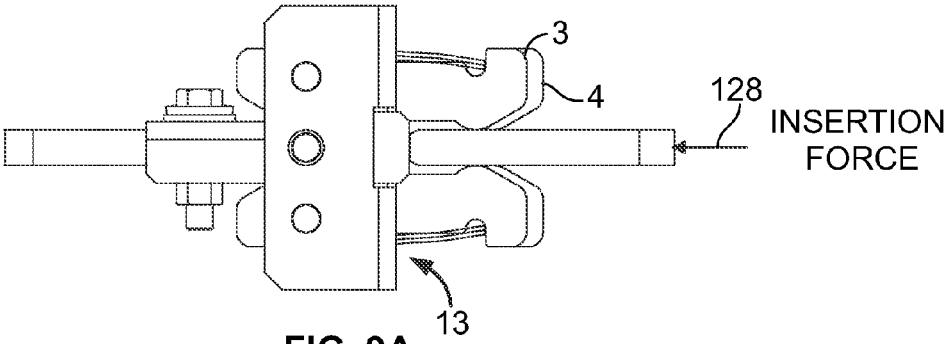
FIG. 9*a* is a top plan view of the bus connector of FIG. 1 after being connected to the example bus of FIG. 1, according to an example embodiment of the present disclosure.
Figure 9B:
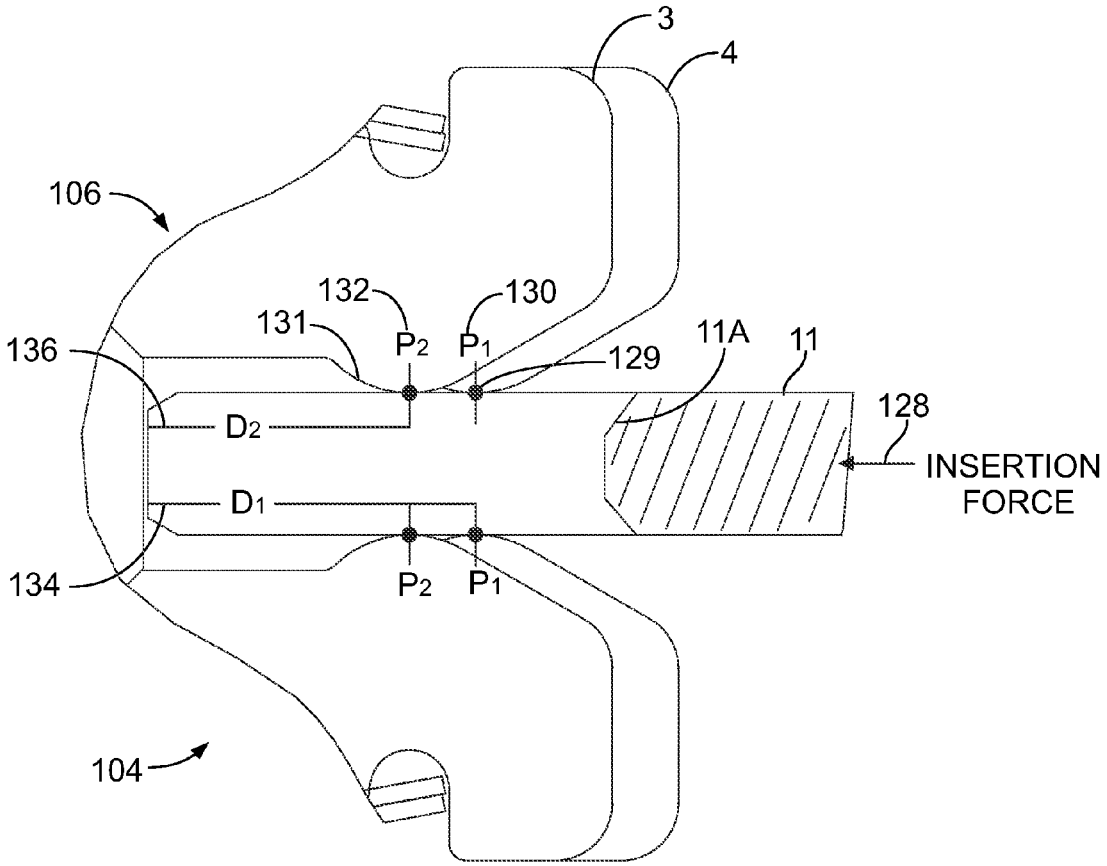
FIG. 9*b* is a magnified top plan view of the bus connector of FIG. 1 after being connected to the example bus of FIG. 1, according to an example embodiment of the present disclosure.

With reference to FIGS. 9*a-b* and 10*a-c*, the contact fingers of the bus connector are arranged such that a frictional force between the contact fingers and the moving bus is distributed between (i) a first point of contact formed by the contact fingers of the first length and (ii) a second point of contact formed by the contact fingers of the second length. As shown in FIGS. 3 and 9*a-b*, the first set 104 includes a plurality of contact fingers of the first length (e.g., contact fingers 4) and a plurality of contact fingers of the second length (e.g., contact fingers 3). Similarly, the second set 106 includes a plurality of contact fingers of the first length (e.g., contact fingers 4) and a plurality of contact fingers of the second length (e.g., contact fingers 3).

Figure 10A:
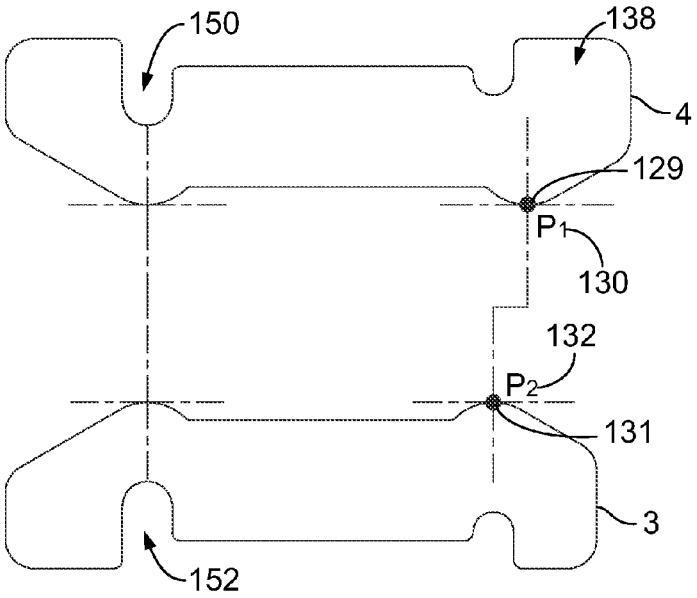
FIG. 10*a* is a top plan view of a first example contact finger and a second example contact finger of the bus connector of FIG. 1, according to an example embodiment of the present disclosure.
Figure 10B:
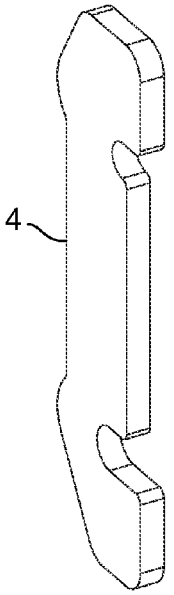
FIG. 10*b* is a perspective view of the first example contact finger of FIG. 10*a*.
Figure 10C:
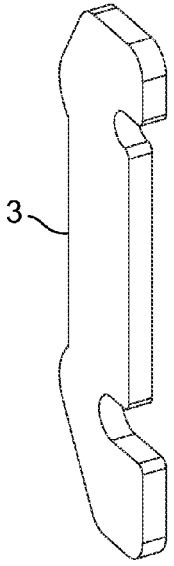
FIG. 10*c* is a perspective view of the second example contact finger of FIG. 10*a*.

In an example embodiment, each contact finger has a contact end having a protrusion extending towards its corresponding contact finger. These protrusions may act to create a point of contact between the contact finger and bus 11 when the bus is inserted. For instance, as illustrated in FIGS. 9*b* and 10*a*, protrusion 129 defines first point of contact P1 130 and protrusion 131 defines second point of contact P2 132. The total frictional force that the insertion force 128 is required to overcome is beneficially staggered between these contact points P1 and P2. For instance, the insertion force 128 must overcome a first half of the total frictional force at point P1 130, and the insertion force must overcome a second half of the total frictional force at point P2 132. More specifically, half of the total frictional force is due to friction (which may be increased due to contact pressure) between the leading edge 11A and long contact fingers 4. Further, the second half of the total frictional force is due to friction (which may be increased due to contact pressure) between the leading edge 11A and short contact fingers 3.

In an example embodiment, the contact fingers may be arranged in a staggered arrangement that spreads out or distributes the total frictional force. For instance, the first set and the second set may each comprise contact fingers of the first length and contact fingers of the second length arranged in a staggered formation. FIG. 3 illustrates an example staggered formation. This example staggered formation comprises a formation of contact fingers alternating in direction 126 between a contact finger of the first length and a contact finger of the second length. Another example staggered formation comprises a formation of contact fingers alternating in a given direction between two contact finger of the first length and two contact finger of the second length. Other staggered formations are possible as well.

FIGS. 10-17 illustrate various views on the connector-bus components of bus connector 13. FIG. 10*a* is a top plan view of long contact finger 4 and short contact finger 3. Further, FIG. 10*b* is a perspective view of long contact finger 4, and FIG. 10*c* is a perspective view of short contact finger 3. These figures illustrate an example contact-finger profile that the contact fingers may take. It should be understood that the depicted contact-finger profile is intended as an example only, and other suitable contact-finger profiles may be used. In the example profile of contact finger 4, contact end 138 is angled and includes a protrusion 129 that forms the contact point P1 130. Beneficially, by the contact end having an angled profile, an inserted bus does not need to be aligned precisely as it is being inserted, as the angled contact end 138 will guide the moving bus into the correct orientation. The contact fingers may also include indentations, such as indentations 150 and 152, to engage with finger rod 6. The contact fingers may be composed of any suitable conducting material. In an example, the contact fingers are made from copper; however, other suitable materials are possible as well.

Figure 11:
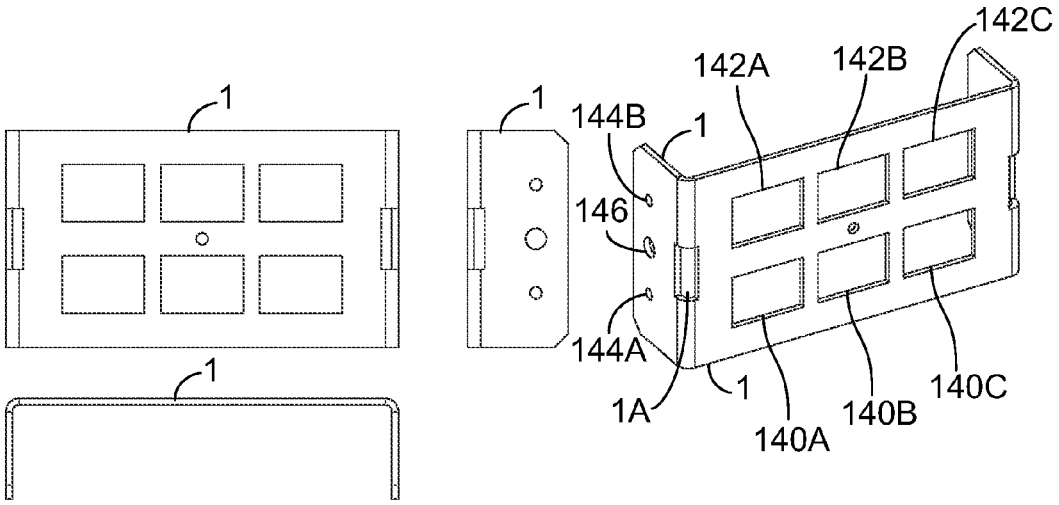
FIG. 11 provides a front view, top view, perspective view, and side view of an example connector frame of the bus connector of FIG. 1, according to an example embodiment of the present disclosure.

FIG. 11 provides example views of connector frame 1 of the bus connector 13. The connector frame 1 has three windows 140*a-c* for the first set 104 of contact fingers, and three windows 142*a-c* for the second set 106 of contact windows. However, more or fewer windows are possible to accommodate more or fewer contact fingers. Additionally or alternatively, the windows may be larger or smaller in order to accommodate different numbers of contact fingers. Connector frame 1 also includes holes 144*a* and 144*b* for connecting with finger rods 6 and hole 146 for connecting with mounting bracket 2. In an example, the connector frame is made from sheet steel; however, other suitable materials are possible as well.

Figure 4:
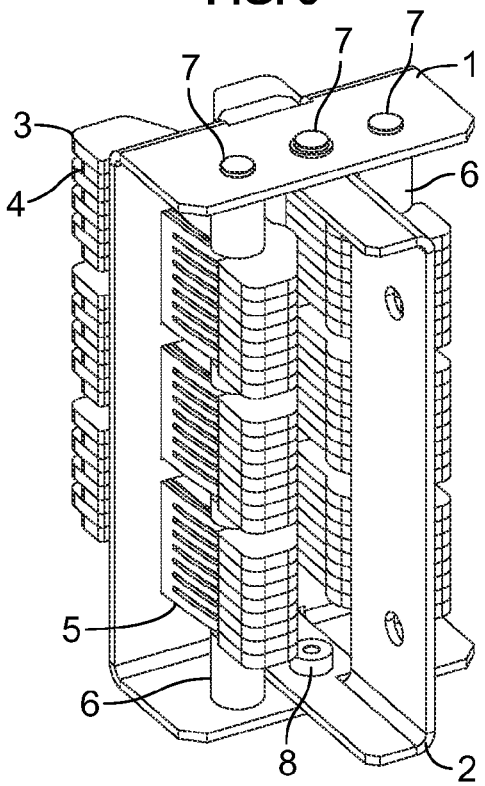
FIG. 4 is a perspective view taken from a top, back, left side of the example bus connector of FIG. 1.
Figure 12:
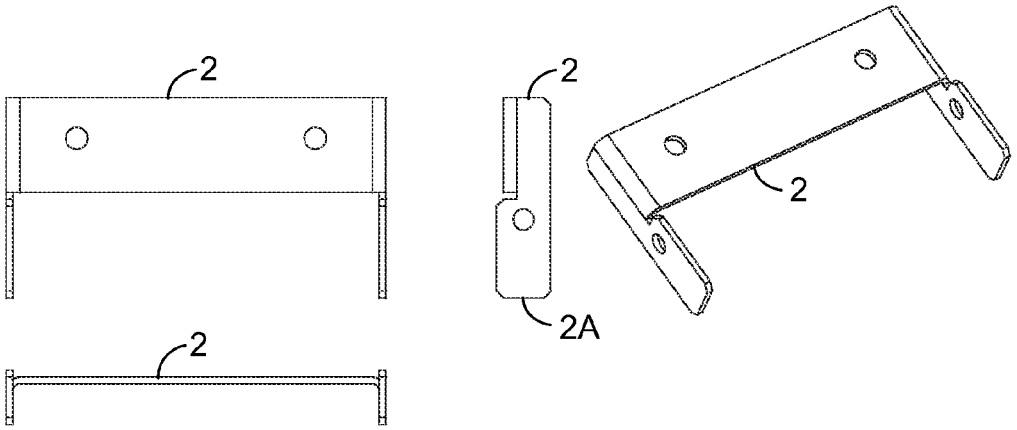
FIG. 12 provides a front view, top view, perspective view, and side view of an example connector mounting bracket of the bus connector of FIG. 1, according to an example embodiment of the present disclosure.

FIG. 12 provides example views of connector mounting bracket 2. As mentioned above, the connector mounting bracket 2 may have a pivot tab 2A. When the connector mounting bracket 2 is attached to connector frame 1, the pivot tab 2A aligns with pivot window 1A. FIG. 4 illustrates the connector mounting bracket connected to connector frame 1. In an example, the connector mounting bracket is made from sheet steel; however, other suitable materials are possible as well.

Figure 13:
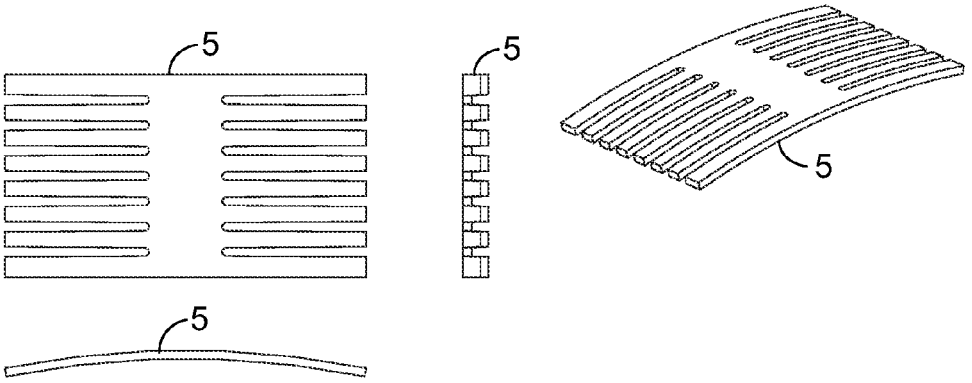
FIG. 13 provides a front view, top view, perspective view, and side view of example connector springs of the bus connector of FIG. 1, according to an example embodiment of the present disclosure.

FIG. 13 provides example views of connector springs 5 of the bus connector. In an example embodiment, spring 5 has arms 148 that are substantially the same thickness as the contact fingers, such that each arm serves to apply a spring force to a respective contact finger. Generally, any suitable spring that serves to exert a spring force on the contact fingers may be used. Further, springs of different spring strength may be used depending on the desired strength of the clamping force of the contact fingers. In an example, the connector springs 5 are made from spring steel; however, other suitable materials are possible as well.

Figure 14:
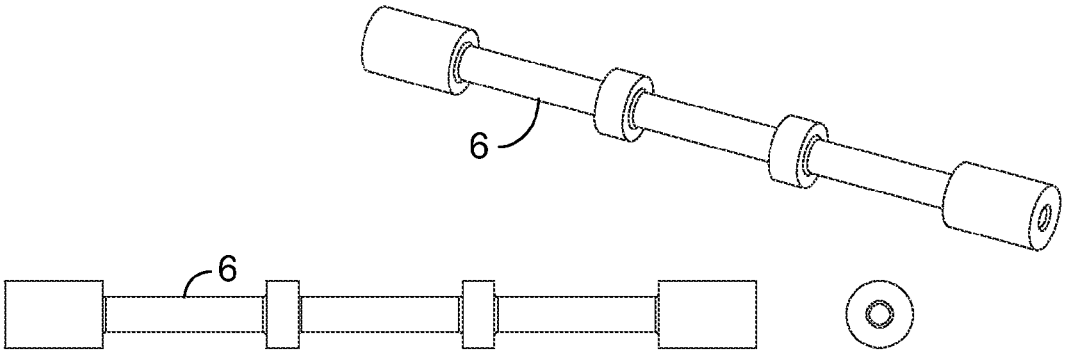
FIG. 14 provides a perspective view and a side view of an example finger rod of the bus connector of FIG. 1, according to an example embodiment of the present disclosure.
Figure 15:
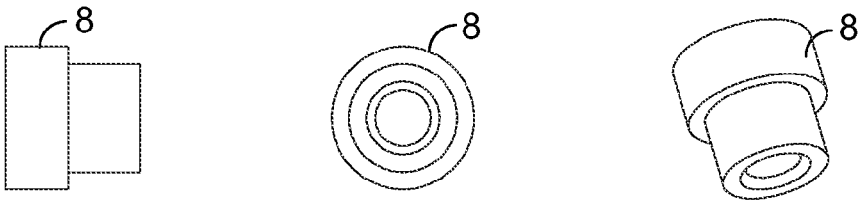
FIG. 15 provides a side view, top view, and perspective view of an example swivel bushing of the bus connector of FIG. 1, according to an example embodiment of the present disclosure.
Figure 16:
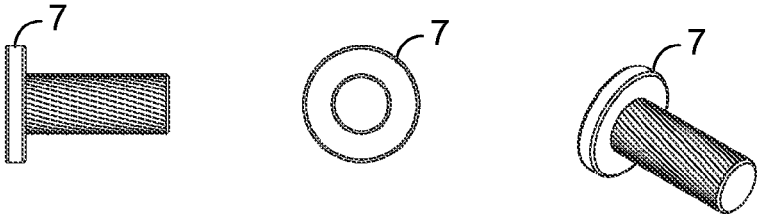
FIG. 16 provides a side view, top view, and perspective view of an example press-in pin of the bus connector of FIG. 1, according to an example embodiment of the present disclosure.
Figure 17:
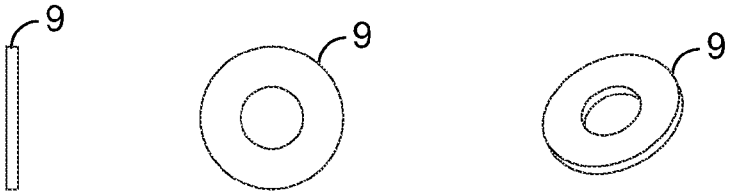
FIG. 17 provides a side view, top view, and perspective view of an example washer of the bus connector of FIG. 1, according to an example embodiment of the present disclosure.

FIG. 14 provides example views of example finger rod 6 of the bus connector; FIG. 15 provides example views of swivel bushing 8 of the bus connector; FIG. 16 provides example views of a press-in pin 7 of the bus connector; and FIG. 17 provides example views of washer 9 of the bus connector. In an example, the finger rods 6, pressed-in pins 7, swivel bushings 8, and washers 9 are made from machined steel; however, other suitable materials are possible as well. As shown in FIG. 5, finger rod 6 may be attached to connector frame 1 using press-in pins 7. Further, mounting bracket 2 may be attached to the connector frame 1 using the swivel bushings 8, washer 9, and press-in pins 7. The swivel bushing 8 may facilitate pivoting of the mounting bracket to allow the bus connector 13 to pivot and align with an inserted bus. It should be understood that these bus-connector components are intended as an example, and other suitable components may be used to form the bus connector.

In the example illustrated bus connectors, each set 104, 106 of contact fingers includes (i) a plurality of contact fingers that create a first contact point at a first distance from the connector frame and (ii) a plurality of contact fingers that create a second contact point at a second distance from the connector frame different from the first distance. For instance, in the example embodiment depicted in FIG. 9*b*, the bus connector 13 includes (i) contact fingers of a first length that create contact point P1 (at distance D1 134 from the connector frame) and (ii) contact fingers of a second length that create contact point P2 (at distance D2 136 from the connector frame). However, in another example embodiment, the contact fingers may be the same length yet still create different contact points P1 and P2. For example, contact fingers of the same length may create different contact points by having the contact-finger protrusions located at different distances. For instance, a contact finger may have a protrusion creating a contact point at distance D1 134 from the connector frame, whereas a contact finger of the same length may have a protrusion creating a contact point at distance D2 136 from the connector frame.

Further, the illustrated embodiments depict a connector bus having contact fingers of two different lengths. The initial insertion force required to overcome the frictional force can be further reduced by introducing additional contact fingers of different lengths (or, as discussed above, contact fingers of the same length that define additional different contact points). Thus, in accordance with an example embodiment, the plurality of contact fingers creates two or more different points of contact between the contact fingers and the bus when the bus is inserted into the bus connector. For example, three fingers of different lengths will result in three points of contact (e.g., P1, P2, P3) with each respective contact point resulting in one-third of the total frictional force. Other examples are possible as well.

3. Example Benefits of the Disclosed Methods and Systems

As described above, the proposed bus connector beneficially reduces the insertion force required to insert a moving bus into the bus connector. A reduced insertion force may beneficially reduce stress exerted on the bus connector components. Further, the disclosed bus connector beneficially is less complex to assemble and install, scalable to different bus sizes, and configurable for different short circuit current levels. From a manufacturing point of view, a scalable design with same components used in different configurations offers various advantages. For example, similar methods of assembly can be used. Further, the number of unique part numbers and unique parts in stock can be kept to minimum, thereby minimizing overall manufacturing costs.

4. Conclusion

While various aspects and embodiments have been disclosed herein, other aspects and embodiments will be apparent to those skilled in the art. The various aspects and embodiments disclosed herein are for purposes of illustration and are not intended to be limiting, with the true scope being indicated by the following claims, along with the full scope of equivalents to which such claims are entitled. It is also to be understood that the terminology used herein is for the purpose of describing particular embodiments only, and is not intended to be limiting.

What is claimed is:

1. A bus connector configured for receiving a bus, the bus connector comprising:

a plurality of contact fingers configured to engage with the bus; and a connector frame, wherein the connector frame is configured to hold the plurality of contact fingers;

wherein the plurality of contact fingers comprise a first set of contact fingers and a second set of contact fingers arranged at least substantially parallel to one another, wherein the first set and second set clamp the bus when the bus is inserted between the first set and the second set;

wherein the plurality of contact fingers comprise contact fingers of a first length and contact fingers of a second length, wherein the second length is different than the first length.

2. The bus connector of claim 1, wherein the first set and the second set each comprise contact fingers of the first length and contact fingers of the second length arranged in a staggered formation.

3. The bus connector of claim 2, wherein the staggered formation comprises a formation of contact fingers alternating between a contact finger of the first length and a contact finger of the second length.

4. The bus connector of claim 1, wherein each contact finger in the first set corresponds to a contact finger in the second set, wherein the corresponding contact fingers exert opposing forces on the bus so as to clamp the bus when the bus is inserted, wherein the corresponding contact fingers are the same length.

5. The bus connector of claim 1, wherein the bus encounters a frictional force between the bus and the contact fingers as the bus is being inserted between the first set and the second set, wherein the plurality of contact fingers are arranged such that a total frictional force is distributed between (i) a first point of contact formed by the contact fingers of the first length and (ii) a second point of contact formed by the contact fingers of the second length.

6. The bus connector of claim 5, wherein each contact finger in the first set corresponds to a contact finger in the second set, wherein each contact finger comprises a contact end having a protrusion extending towards the corresponding contact finger, and wherein the protrusion creates the first or second point of contact.

7. The bus connector of claim 6, wherein a first half of total frictional force is between the contact fingers of the first length and the bus at the first point of contact, and wherein a second half of the total frictional force is between the contact fingers of the second length and the bus at the second point of contact.

8. The bus connector of claim 1, wherein the first set and the second set are capable of outward deflection when the bus is pushed inwardly with respect to the contact fingers.

9. The bus connector of claim 8, wherein each contact finger is configured to apply contact pressure on the bus to clamp the bus when the bus is inserted.

10. The bus connector of claim 9, further comprising:

a plurality of springs, wherein each spring is configured to exert pressure on a respective contact finger so as to provide the contact pressure on the bus when the bus is inserted.

11. The bus connector of claim 1, wherein the connector frame is pivoted to move about an axis, so as to allow the connector bus to pivot and align with a moving bus.

12. The bus connector of claim 1, wherein the connector frame comprises:

a first rod configured to support the first set of contact fingers; and a second rod configured to support the second set of contact fingers.

13. A bus connector configured for receiving a bus, the bus connector comprising:

a plurality of contact fingers configured to engage with the bus; and a connector frame, wherein the connector frame is configured to hold the plurality of contact fingers;

wherein the plurality of contact fingers comprise a first set of contact fingers and a second set of contact fingers arranged at least substantially parallel to one another, wherein the first set and second set clamp the bus when the bus is inserted between the first set and the second set;

wherein each set of contact fingers comprises (i) a plurality of contact fingers that create a first contact point at a first distance from the connector frame and (ii) a plurality of contact fingers that create a second contact point at a second distance from the connector frame different than the first distance.

14. The bus connector of claim 13, wherein each contact finger in the first set corresponds to a respective contact finger in the second set, wherein each contact finger comprises a respective contact end having a respective protrusion extending towards the respective corresponding contact finger, and wherein the respective protrusion creates a point of contact between the respective contact finger and the bus when the bus is inserted.

15. The bus connector of claim 13, wherein each set of contact fingers further comprises a plurality of contact fingers that create a third contact point at a third distance from the connector frame different than both the first distance and the second distance.

16. The bus connector of claim 13, wherein the plurality of contact fingers that create the first contact point at the first distance from the connector frame and the plurality of contact fingers that create the second contact point at the second distance from the connector frame are arranged in a staggered formation.

17. A bus connector configured for receiving a bus, the bus connector comprising:

a plurality of contact fingers configured to engage with the bus; and a connector frame, wherein the connector frame is configured to hold the plurality of contact fingers;

wherein the plurality of contact fingers comprise a first set of contact fingers and a second set of contact fingers arranged at least substantially parallel to one another, wherein the first set and second set clamp the bus when the bus is inserted between the first set and the second set;

wherein the plurality of contact fingers create at least two different points of contact between the contact fingers and the bus when the bus is inserted into the bus connector.

18. The bus connector of claim 17, wherein each contact finger in the first set corresponds to a respective contact finger in the second set, wherein each contact finger comprises a respective contact end having a respective protrusion extending towards the corresponding contact finger, wherein the respective protrusion creates a point of contact between the contact finger and the bus when the bus is inserted, and wherein each respective protrusion creates one of the at least two different points of contacts.

19. The bus connector of claim 17, wherein the at least two different points of contact comprise (i) a first contact point at a first distance from the connector frame and (ii) a second contact point at a second distance from the connector frame different from the first distance.

20. The bus connector of claim 17, wherein the connector frame is pivoted to move about an axis, so as to allow the connector bus to pivot and align with a moving bus.

* * * * *